US006582266B1

(12) United States Patent
Steger et al.

(10) Patent No.: US 6,582,266 B1
(45) Date of Patent: Jun. 24, 2003

(54) PERSONAL FLOTATION DEVICE

(75) Inventors: Ralph E. Steger, Baxley, GA (US); David Carter, Hazlehurst, GA (US)

(73) Assignee: Hedstrom Corporation, Arlington Heights, IL (US)

( * ) Notice: Subject to any disclaimer, the term of this patent is extended or adjusted under 35 U.S.C. 154(b) by 0 days.

(21) Appl. No.: 09/683,438

(22) Filed: Dec. 28, 2001

(51) Int. Cl.[7] ..... B63C 9/08
(52) U.S. Cl. ..... 441/106; 441/117
(58) Field of Search ..... 441/106, 114, 441/115, 117; 24/306, 163 R, 164, 182, 166

(56) References Cited

U.S. PATENT DOCUMENTS

| | | | | |
|---|---|---|---|---|
| 715,938 A | | 12/1902 | Armstrong | |
| 1,065,385 A | | 6/1913 | Bailey | |
| 1,850,660 A | | 3/1932 | Coppel | |
| 2,629,118 A | | 2/1953 | Frieder et al. | |
| 3,181,183 A | * | 5/1965 | Allen | 441/116 |
| 3,903,555 A | | 9/1975 | Busby | |
| 3,956,786 A | * | 5/1976 | O'Link | 441/112 |
| 4,114,297 A | * | 9/1978 | Famolare, Jr. | 24/306 |
| 4,871,338 A | | 10/1989 | Hoffman | |
| 5,030,153 A | | 7/1991 | Bailey | |
| 5,249,999 A | | 10/1993 | Steger | |
| 5,766,114 A | | 6/1998 | Campbell | |
| 6,089,936 A | | 7/2000 | Hoffman | |

* cited by examiner

*Primary Examiner*—Stephen Avila
(74) *Attorney, Agent, or Firm*—Wedder Price Kaufman & Kammholz

(57) ABSTRACT

A personal flotation device, includes a shell defining a cavity having a first portion and a second portion for each receiving a buoyant element where the first and second portions are relatively moveable. Aa fastener for releasably interconnecting the first and second portions having a first and a second part such that when interconnected relative movement of the first and second portions is limited. A safety device is connected to the second portion and is associated with the first part of the fastener for redundant interconnection of the first and second portions in the event that the fastener is unintentionally disconnected.

17 Claims, 2 Drawing Sheets

PERSONAL FLOTATION DEVICE

BACKGROUND OF INVENTION

The present invention is directed to a personal flotation device ("PFD") having improved flotation support and interconnection with a wearer. More in particular, the present invention includes an improved shell having buoyant elements and fastener assembly to interconnect the PFD to the wearer and thereby apply buoyant forces to lift the wearer's body in water. The PFD is structured to comfortably support the wearer's head above water level and to tend to orient the head into a face-up attitude while the wearer is in water. Further, the improved PFD is preferably adaptable for use with infants, children and other wearers with little or no experience swimming or in the water.

Various types of life vests or personal flotation devices exist which are designed to be worn or otherwise used by a wearer to keep the wearer afloat in a body of water. Such flotation devices, also referred to as marine buoyant devices, are currently in wide use in the recreational, commercial and military areas. In addition, flotation devices having certain performance characteristics are a legal requirement in the operation of boats and ships of various sizes.

The United States Coast Guard ("USCG") has established guidelines for determining the performance level of a life vest or personal flotation device, based on the lifesaving capacity of such devices. For instance, Underwriters Laboratories, Inc., which is understood by the inventor hereof to be an approved testing agency for the USCG, lists several categories of "Buoyant Devices" in its Mar. 29, 1996 handbook entitled "UL 1123 Standard for Marine Buoyant Devices" which is incorporated herein by reference.

One of these categories is for a Type I device, also referred to as an "off-shore" PFD which is intended to turn most unconscious wearers face up on the water and which is best suited for open, rough or remote water where rescue may be slow in coming. There is also a Type II device, sometimes also referred to as a "near shore PFD", which is "intended to turn some unconscious persons from a face down position in the water to a position where the wearer's respiration is not impeded." These PFDs are good for calm, inland water or where there is a good chance to fast rescue. Other categories of PFDs include a Type III device, which is "intended to support a conscious person in the water in an upright position or backward position but is not required to turn an unconscious person in the water from a face-down position to a position where the wearer's respiration is not impeded." As such, a Type III device is not suitable for an unconscious wearer because a wearer may have to tilt his or her head back to avoid going face down in the water, and further, his or her face may often be covered by waves. There is also a Type IV device, which is "intended to be thrown to and grasped by a person in the water" and which does not need to provide any means for closely fitting about the person's body. Of course, the Type IV device is also not suitable for an unconscious person, but also not even for a non-swimmer, as such devices require a person to hold on for buoyant support.

In addition, the USCG subjects PFDs to certain "tests" such as the "Donning Test" wherein the PFD must be capable of being donned in a short period of time, usually one minute or less, and a "Flotation Stability Test," to name a few. There are others, such as a "freeboard test," which measures a distance perpendicularly from the surface of the water to the lowest point where the wearer's respiration may be impeded, a "head support" test, a "face plan angle" test, and a "chin support" test, with specific criteria for passing such tests. As one might imagine, to qualify as a Type I or a Type II device, there is also a "turning test." Of course, several PFDs have been developed which meet the various testing and other criteria of the USCG for the foregoing "Types" of devices.

The USCG requires that approved PFDs be available on a boat, although the number and type depend on the number of people on board, the size and type of boat, and the kind of boating. Of course, a PFD can only be helpful in an emergency on the water if it is readily available. As one never knows when an emergency situation will arise, it would naturally be best for persons who are out on the water or on a boat to wear a PFD at all times. The USCG's booklet entitled "Think Safe Choose the Right Personal Flotation Device (PFD)" reports that most drownings do not occur way out at sea, but instead, that nine (9) out of ten (10) drownings occur in inland waters. Given this fact, and a choice among the various "Types" of PFDs, it would be preferable for recreational boaters and the like on inland waters to carry at least Type II PFDs on board, and further, to wear such PFDs at all times.

Regarding infants and toddlers, PFDs must provide additional support as these children do not know how to swim and often lack the awareness to refrain from actions which may cause the PFD to become unattached. Frightened children flail about in an attempt to regain a certain comfort zone. As a result loosely connected or fitting PFDs become partially or completely separated from the infant wearer. Further, it is important for an infant PFD to turn the infant to a face-up position without effort from the child.

There has, however, been a persistent problem in the art relating to adequate support in connection of the wearer to a Type II PFD when it is being worn by a person with little or no experience swimming or in the water who may be helpless to save themselves without a PFD, namely, infants, children, and others similarly situated. Presumably, this is also true of Type I PFDs as well. This discussion will refer more to Type II PFDs but its teachings are not so limited.

More in particular, with all of the known Type II PFDs, there is a tendency for the PFD to "ride up" from the intended position about the torso of the wearer. This "ride-up" tendency creates a situation where an inexperienced wearer is more susceptible to becoming separated from the PFD. Further, the cause for the tendency to ride up is a loose fitting design. The problem of separation from the PFD is exacerbated by this loose fitting design. This is particularly troublesome where infants or inexperienced swimmers are involved.

Accordingly, there remains a need in the art for a PFD which not only meets the lifesaving criteria of all the USCG for a Type II device, but which supports the wearer in a face up position and is securely fastened to the body of the wearer such that the wearer may not easily be separated therefrom. Ideally, any such PFD should permit the wearer freedom of movement even when immersed in water. Any such PFD should also be relatively simple in construction, inexpensive to manufacture, and capable of enabling a person to determine easily how to don the PFD, so that it may be readily donned in a short period of time.

SUMMARY OF INVENTION

The personal flotation device of the present invention is primarily for use with an infant or a person weighing less than 30 pounds. However, adjustments as to scale may be used for wearers of larger dimensions and the teachings of this invention are not so limited. A personal flotation device has a shell defining a cavity having a first portion, a second portion, and a third portion. A first buoyant element is disposed in the first portion of the cavity. A second buoyant element is disposed in the second portion of the cavity. An opening is defined by a penannular portion and a gap defined between a first end and a second end of the penannular portion. The opening is generally disposed between the first and second portions of the shell and is adapted to receive and retain a first portion of a wearer's body. The third portion extends from the first portion, opposite the second portion and is connected to the second portion. The first and second buoyant elements are relatively movable about the opening for installation on and removable from the wearer's body. A first fastener including a first part connected adjacent the first end of the penannular portion and a second part connected adjacent the second end of the penannular portion releasably interconnect the first and second ends of the penannular portion to limit relative movement of the first and second portions. A safety is operatively associated with the first fastener for redundant interconnection of the first and second ends of the penannular portion. A strap connected to the first portion has a free end for encircling the wearer's body. A handle is connected to the second portion for lifting the wearer.

BRIEF DESCRIPTION OF DRAWINGS

The features of the present invention which are believed to be novel are set forth with particularity in the pending claims. The invention may be best understood by reference to the following description taken in conjunction with the accompanying drawings, in the several figures of which like reference numerals identify like elements.

DETAILED DESCRIPTION

Figure 1:
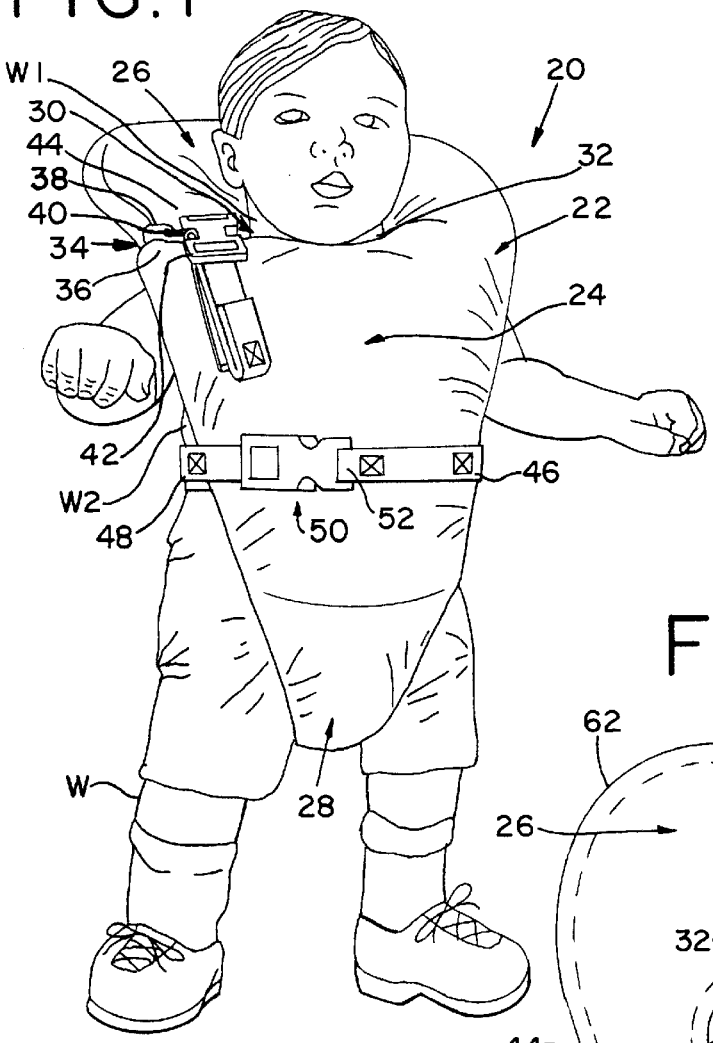
FIG. 1 is a perspective view of the personal flotation device of the present invention as worn by a wearer.

FIG. 1 shows a perspective view of the PFD 20 in accordance with an embodiment of this invention. A wearer W has donned the PFD 20 which includes a shell 22, having a first portion 24, a second portion 26, and a third portion 28. An opening 30 is defined by a penannular portion 32 and a gap 34 defined between a first end 36 and a second 38 of the penannular portion 32. The opening 30 is disposed generally between the first and second portions 24 and 26 of the shell 22 and is adapted to receive and retain a first portion W1 of a wearer's W body.

A first fastener 40 including a first part 42 is connected to the first portion 24 adjacent the first end 36 of the penannular portion 32 and a second part 44 connected to the second portion 26 adjacent the second end 38 of the penannular portion 32 for releasably interconnecting the first and second ends 36 and 38 of the penannular portion 32 to limit relative movement of the first and second portions 24 and 26.

A strap 46 is connected to the first portion 24 and has a free end 48 for encircling the wearer's W body. The strap 46 further includes a second fastener 50 for releasably interconnecting a first end 52 and a free end 48 of the strap 46.

Figure 2:
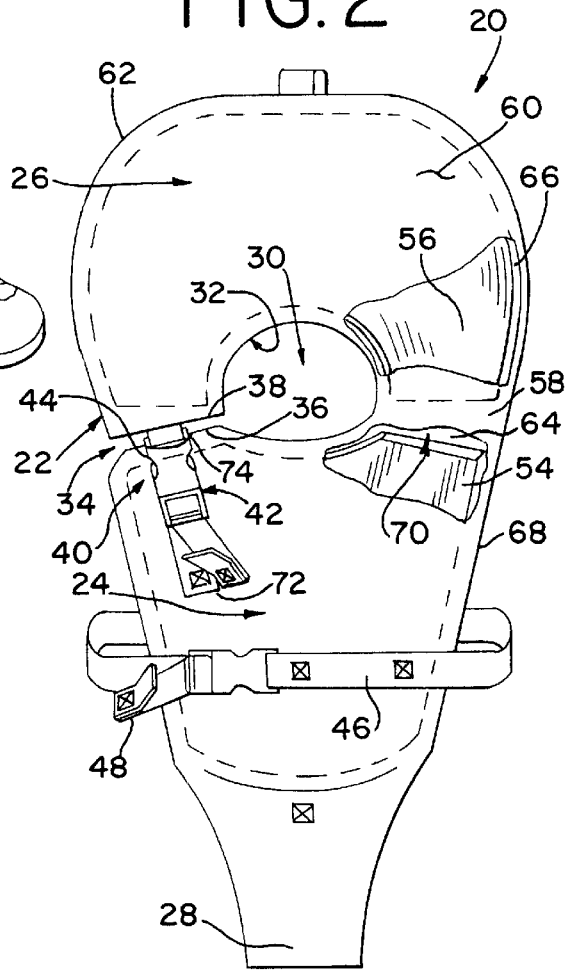
FIG. 2 is a front elevation view of the PFD of FIG. 1 including broken-away portions of a shell showing the buoyant elements.

FIG. 2 shows a front elevation view of the PFD 20 of FIG. 1 with two partially broken away sections showing a first buoyant element 54 and a second buoyant element 56. The shell 22 includes a first material element 58 having a first surface 60 and a first peripheral edge 62, and a second material element 64 having a second surface 66 and a second peripheral edge 68. The first and second material elements 58 and 64 are interconnected about the first and second peripheral edges 62 and 68 to define a cavity 70 therebetween. The first and second material elements 58 and 64 may be formed from any suitable material, for example, nylon, coated nylon, polyester, coated polyester, or poly-cotton or other material conventionally used in this industry for the stated purpose. Interconnection of the material elements about the first and second peripheral edges is achieved by stitching with a thread. Any suitable thread may be used, for example, nylon or polyester thread. Any suitable conventional stitch type may be used for stitching, for example, stitch Type 301 is used on all structural seams, and stitch Type 515 is used in lieu of Type 301 on non-structural seams, such as overlays.

The cavity 70, defined within the shell 22, has a corresponding first portion 24, second portion 26, and third portion 28. The first portion 24 is generally medially disposed between the second and third portions 26 and 28. The first buoyant element 54 is disposed in the first portion 24 of the cavity 70. The second buoyant element 56 4is disposed in the second portion 26 of the cavity 70. The buoyant elements 54 and 56 may be formed from any suitable material to achieve the desired buoyancy tolerance. For example, the buoyant element material may be formed from polyvinyl cloride or polyethylene or the combination of polyvinyl cloride and polyethylene. Further, the buoyant elements may be formed from the different materials described above in any combination such that the front buoyant distribution tolerance is 52% or greater. Preferably, the front buoyant distribution tolerance is 55% or greater. The buoyant material may have a conventional structure and be commonly available, such as the products from Airex AG, product S30.50, and/or Ensolite, Inc., products MLC, MLC-2, or MFC-2, and/or Rubatex Corp., product FLO-10, and/or United Technologies, product 768.12 and/or Sealed Air Corp., products ¼FF-1, -2, -3, or -4, and/or Sentinel Product Corp., product HF-¼.

The opening 30 formed in the shell 22 is defined by a penannular portion 32 and a gap 34 defined between the first end 36 and a second end 38 of a penannular portion 32.

The first fastener 40 includes a first part 42 connected to the first portion 24 adjacent the first end 36 of the penannular portion 32, and a second part 44 connected to the second portion 26 adjacent the second end 38 of the penannular portion 32 for releasably interconnecting the first and second ends 36 and 38 to limit relative movement of the first and second portions 24 and 26. The first part 42 includes a strap 72 connected to the first portion 24, such that the first part 42 is disposed at a position along the length of the strap 72. The dimension of the opening 30 and gap 34 may be adjusted and controlled by the position of the first part 42 on the strap 72. Preferably, the first part 42 is adjusted on the strap 72 such that the opening 30 is disposed snugly around the first part of the wearer's body.

The strap 46 connected to the first portion 24 and has a free end 48 for encircling the wearer's body. The strap 46 may have any suitable construction. For example, a one inch wide webbing may be provided, however, other sizes and styles may be used. The cut ends of the webbing are heat-sealed. The strap 46 is connected to the first portion 24 by any suitable manner. For example, a Box-X or Bar-Tack stitching method may be used. Other webbing used in connection with the present invention may also be attached to the shell 22 with either of the above stitches. The free end 48 of the strap 46 is adjusted to snuggly fit the PFD 20 to the wearer's body.

A safety device 74 is connected to the first portion 24 adjacent the first end 36 of the penannular portion 32 and is operatively associated with the first fastener 40 for redundant interconnection of the first and second ends 36 and 38 of the penannular portion 32. The safety device 74 may be formed of any suitable material and in any suitable manner such that the first and second portions 24 and 26 remain interconnected in the event that the first fastener 40 is unintentionally disconnected. The safety device 74 may be formed of any suitable material. For example, a one-quarter inch (¼") flat polypropylene cord, such as Style 637 from William M. Jette and Son, Inc. which is secured to the first portion 24 with a minimum of three rows of back stitching. The safety device 74 is defeated by carefully threading the second part 44 therethrough.

The third portion 28 extends from the first portion 24 opposite the second portion 26, and is interconnected to the second portion 26 as will be discussed below.

Figure 3:
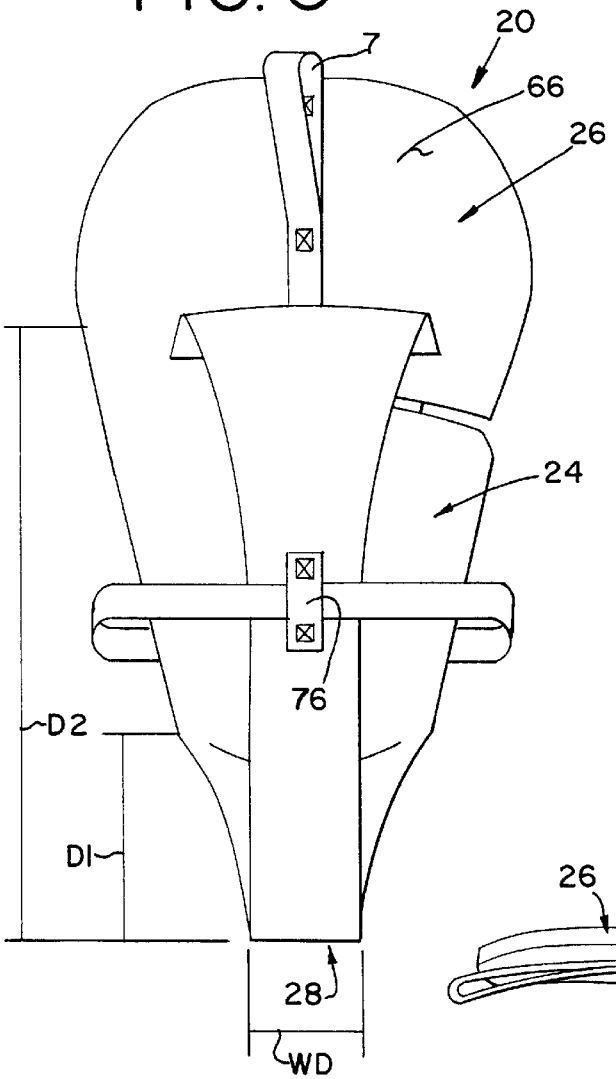
FIG. 3 is a rear elevation view of the PFD of FIG. 1.

FIG. 3 shows a rear elevation view of the PFD 20 of FIG. 1. The third portion 28 has a tapered configuration such that a width dimension WD of the third portion 28 decreases for a first distance D1 from the first portion 29, then increases for a second distance D2 for supporting a second portion W2, see FIG. 1, of the wearer's body. It will be noted by those of skill in the art, that the third portion 28 passes through the legs of the wearer in order to prevent the PFD 20 from riding up. The first portion 24 associated with the torso of the wearer's body pushes up against the wearer's chin. The width dimension WD near the second portion 26 has sufficiently increased to support the width of the second portion W2 of the wearer. It will be noted by those of skill in the art, that this structural configuration keeps the second portion 26 securely associated with the wearer. Further, the increased width dimension WD of the third portion 28 prevents the wearer from easily falling out of the PFD 20. This is further enabled when the third portion 28 is interconnected to the second portion 26 adjacent the penannular portion at a point A. A loop 76 is connected to the third portion 28 and may have a structural configuration as described for the strap 46. The loop 76 is configured to receive and position the strap 46 while encircling the wearer's body. It will be noted by those of skill in the art, that the loop 76 further aids in preventing separation of the wearer from the PFD 20 through sideways movement. The loop 76 is connected to the third portion 28 with any suitable stitching technique described above.

A handle 78 is connected to the second portion 26. The handle 78 may be formed from any suitable material. For example, the handle may be formed from webbing similar to that used for the strap 46 or loop 76. Likewise, the handle 78 is connected to the second surface 66 of the second portion 26 by any suitable stitching technique described above.

Figure 4:
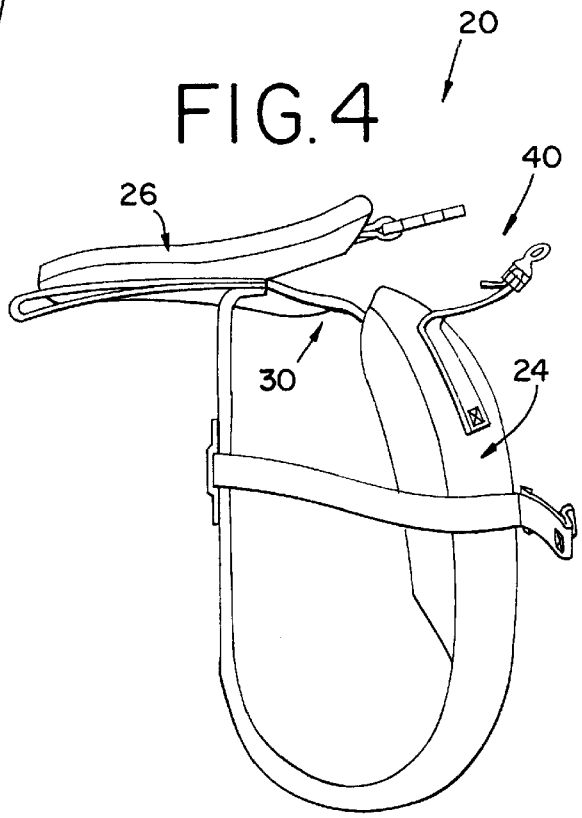
FIG. 4 is a side perspective view of the PFD of FIG. 1 showing a disconnected first fastener and the first and second portions relatively movable.

FIG. 4 shows a side perspective view of the PFD 20 of FIG. 1 wherein the first fastener 40 has been releasably disconnected. The first and second portions 24 and 26 and the corresponding buoyant elements are movable about the opening 30. This ease of movement, whereby the dimension of the opening and the gap may be increased or decreased, aids in the donning of the PFD 20.

The invention is not limited to the particular details of the apparatus depicted and other modifications and applications may be contemplated. Certain other changes may be made in the above-described apparatus without departing from the true spirit and scope of the invention herein involved. It is intended, therefore, that the subject matter of the above depiction shall be interpreted as illustrative and not in a limiting sense.

What is claimed is:

1. A personal flotation device, comprising:

shell defining a continuously-formed cavity having a first portion, a second portion, and a third portion; the first potion disposed between the second portion and the third portion at opposing ends;

a first buoyant element disposed in the first portion of the cavity;

a second buoyant element disposed in the second portion of the cavity;

an opening defined by a penannular portion and a gap defined between a first end and a second end of the penannular portion;

the opening disposed generally between the first and second portions of the shell and adapted to receive and retain a first portion of a wearer's body;

the third portion extending from the first portion opposite the second portion and interconnected to the second portion; and, the first and second buoyant elements relatively moveable about the opening for installation and removal from the wearer's body.

2. The personal flotation device of claim 1, wherein a first fastener includes a first part connected to the first portion adjacent the first end of the penannular portion and a second part connected to the second portion adjacent the second end of the penannular portion for releasable interconnection of the first and second ends of the penannular portion to limit relative movement of the first and second portions.

3. The personal flotation device of claim 1, wherein a strap is connected to the first portion and has a free end for encircling the wearer's body.

4. The personal flotation device of claim 3, wherein the strap includes a second fastener for releasably interconnecting a first end of the strap and the free end of the strap.

5. The personal flotation device of claim 1, wherein the third portion has a tapered configuration such that a width dimension of the third portion increases to support a second portion of the wearer's body.

6. The personal flotation device of claim 1, wherein the third portion is interconnected to the second portion adjacent the penannular portion.

7. The personal flotation device of claim 1, wherein a handle is connected to the second portion.

8. A personal flotation device comprising: a shell defining a cavity having a first portion, a second portion, and a third portion; a first buoyant element disposed in the first portion of the cavity; a second buoyant element disposed in the second portion of the cavity; an opening defined by a penannular portion and a gap defined between a first end and a second end of the penannular portion; the opening disposed generally between the first and second portions of the shell and adapted to receive and retain a first portion of a wearer's body; the third portion extending from the first portion opposite the second portion and interconnected to the second portion; the first and second buoyant elements relatively moveable about the opening for installation on and removal from the wearer's body; a first fastener including a first part connected to the first portion adjacent a first end of the penannular portion and a second part connected to the second portion adjacent a second end of the penannular portion for releasably interconnecting the first and second ends of the penannular portion to limit relative movement of the first and second portions; and, a safety operatively associated with the first fastener for redundant interconnection of the first and second ends of the penannular portion.

9. The personal flotation device of claim 8, wherein a strap is connected to the first portion and has a free end for encircling the wearer's body.

10. The personal flotation device of claim 9, wherein the strap includes a second fastener for releasably interconnecting a first end of the strap and the free end of the strap.

11. The personal flotation device of claim 8, wherein the third portion has a tapered configuration such that a width dimension of the third portion increases to support a second portion of the wearer's body.

12. The personal flotation device of claim 8, wherein the third portion is connected to the second portion adjacent the penannular portion.

13. The personal flotation device of claim 8, wherein a handle is connected to the second portion.

14. A personal flotation device, comprising: a shell including a first material element having a first surface and a first peripheral edge, and a second material element having a second surface and a second peripheral edge such that the first and second material elements are interconnected about the first and second peripheral edges to define a cavity therebetween; the shell having a first portion, a second portion and a third portion, where the first portion is medially disposed between the second and third portions; a first buoyant element disposed in the first portion; a second buoyant element disposed in the second portion; an opening defined by the shell extending from the first surface to the second surface defined by a penannular portion and a gap defined between a first and second end of the penannular portion; a first fastener including a first part connected adjacent the first end of the penannular portion and a second part connected adjacent the second end of the penannular portion for releasably interconnecting the first and second ends to limit relative movement of the first and second portions; the third portion extending from the first portion opposite the second portion and interconnected to the second surface of the second portion; and, a strap connected to the first portion and having a free end for encircling a wearer's body.

15. The personal flotation device of claim 14, wherein a safety device is operatively associated with the first fastener for redundant interconnection of the first and second ends of the penannular portion.

16. The personal flotation device of claim 14, wherein the third portion has a tapered configuration including a width dimension which increases in relation to a distance from the first portion, for supporting a second portion of the wearer's body.

17. A personal flotation device, comprising:

a shell defining a continuously-formed cavity having a first portion and a second portion for each receiving at least one buoyant element where the first and second portions are relatively moveable;

a fastener for releasable interconnecting the first and second portions having a first part and a second part such that when interconnected relative movement therebetween is limited; and, a safety device connected to the second portion and operatively associated with the first part of the fastener in the event that the fastener is unintentionally disconnected.

* * * * *